US009109360B2

(12) United States Patent
Stewart

(10) Patent No.: US 9,109,360 B2
(45) **Date of Patent: *Aug. 18, 2015**

(54) INSULATING FIRE AND BLAST RESISTANT WINDOW AND DOOR BUCK

(71) Applicant: Gorilla Buck Inc., Pelican Rapids, MN (US)

(72) Inventor: Cooper Edward Stewart, Pelican Rapids, MN (US)

(73) Assignee: Gorilla Buck Inc., Pelican Rapids, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/677,259

(22) Filed: Nov. 14, 2012

(65) Prior Publication Data

US 2014/0130432 A1 May 15, 2014

Related U.S. Application Data

(60) Provisional application No. 61/629,150, filed on Nov. 14, 2011.

(51) Int. Cl.

| | |
|---|---|
| ***E06B 1/04*** | (2006.01) |
| ***E04B 1/94*** | (2006.01) |
| ***E04B 1/98*** | (2006.01) |
| ***E06B 1/02*** | (2006.01) |
| ***E06B 5/16*** | (2006.01) |
| *E06B 1/60* | (2006.01) |

(52) U.S. Cl.

CPC ... *E04B 1/98* (2013.01); *E06B 1/02* (2013.01); *E06B 5/16* (2013.01); *E06B 1/6038* (2013.01)

(58) Field of Classification Search

CPC ..... E04B 1/98; E04B 1/94; E04B 1/04; E04B 1/02; E04B 1/30; E04B 1/32; E04B 1/6038; E04B 5/16

USPC ..... 52/204.1, 215, 216, 426, 427, 656.5, 52/745.16, 699, 309.12; 249/36, 39; 49/504, 505, DIG. 1

See application file for complete search history.

(56) References Cited

U.S. PATENT DOCUMENTS

| | | | | |
|---|---|---|---|---|
| 1,640,595 | A * | 8/1927 | Buss | 49/504 |
| 2,166,870 | A | 7/1939 | Livesay | |
| 2,893,235 | A * | 7/1959 | Goldberg | 52/204.55 |
| 3,160,926 | A * | 12/1964 | Brose | 49/401 |
| 3,230,676 | A * | 1/1966 | Glover | 52/223.1 |

(Continued)

FOREIGN PATENT DOCUMENTS

DE 4431319 A1 * 3/1996

*Primary Examiner* — Rodney Mintz

(74) *Attorney, Agent, or Firm* — Dardi & Herbert, PLLC; Curtis B. Herbert; Kayla J. Fossen

(57) ABSTRACT

An insulating fire and blast resistant window and door buck is described that is designed for use with an insulated concrete wall form. The window and door buck described provides a core of concrete for fire and blast protection while also providing structural concrete for attaching window and door elements. In some embodiments, the window and door buck comprises two pieces of insulation that are separated by a gap and held together by a tie piece. The insulation pieces are proportioned to so that an alignment element fits inside the cavity of the wall form. When the buck is placed in an insulated wall form and concrete is poured into the form a strip of concrete fills the gap, resulting in a fire and blast resistant wall.

15 Claims, 13 Drawing Sheets

(56) References Cited

U.S. PATENT DOCUMENTS

| | | | | | |
|---|---|---|---|---|---|
| 3,439,894 | A * | 4/1969 | Haider | 249/39 |
| 4,423,578 | A * | 1/1984 | Meigs et al. | 52/396.04 |
| 4,430,831 | A * | 2/1984 | Kemp | 52/204.53 |
| 4,488,391 | A * | 12/1984 | Pavnica | 52/745.16 |
| 5,319,884 | A * | 6/1994 | Bergeron | 49/504 |
| 5,458,828 | A * | 10/1995 | Chuang | 264/35 |
| 5,746,033 | A * | 5/1998 | Chuang | 52/213 |
| 5,843,323 | A * | 12/1998 | Ranard | 249/39 |
| 5,996,293 | A | 12/1999 | Anderson et al. | |
| 6,070,375 | A | 6/2000 | Anderson et al. | |
| 7,587,868 | B2 * | 9/2009 | Hughes | 52/215 |
| RE43,251 | E * | 3/2012 | Anderson et al. | 52/204.54 |
| RE43,457 | E * | 6/2012 | Anderson et al. | 52/215 |
| 8,458,969 | B2 * | 6/2013 | Richardson et al. | 52/215 |
| 8,495,843 | B1 * | 7/2013 | Horneland | 52/215 |
| 8,544,224 | B1 * | 10/2013 | Hafendorfer et al. | 52/215 |
| 8,752,345 | B1 | 6/2014 | Kometas | |
| 8,776,459 | B1 * | 7/2014 | Theophilus | 52/204.72 |
| 8,881,492 | B2 * | 11/2014 | Piccirillo | 52/745.15 |
| 8,931,220 | B2 * | 1/2015 | Stewart et al. | 52/215 |
| 2003/0005659 | A1 * | 1/2003 | Moore, Jr. | 52/473 |
| 2006/0151677 | A1 * | 7/2006 | McIvor et al. | 249/36 |
| 2007/0204535 | A1 * | 9/2007 | Hughes | 52/215 |
| 2008/0115431 | A1 * | 5/2008 | Mill | 52/215 |
| 2009/0193729 | A1 * | 8/2009 | Kustermann | 52/215 |
| 2009/0205272 | A1 * | 8/2009 | Rosende | 52/215 |
| 2010/0071306 | A1 * | 3/2010 | Williams et al. | 52/712 |
| 2010/0154329 | A1 * | 6/2010 | Adkins et al. | 52/204.1 |
| 2010/0251645 | A1 * | 10/2010 | Philippe | 52/215 |
| 2010/0269433 | A1 * | 10/2010 | Westra | 52/215 |
| 2011/0083382 | A1 * | 4/2011 | Sanders | 52/215 |
| 2011/0185661 | A1 * | 8/2011 | Nauck et al. | 52/309.4 |
| 2011/0214370 | A1 * | 9/2011 | Stewart | 52/215 |
| 2012/0005975 | A1 * | 1/2012 | Kim | 52/209 |
| 2012/0186172 | A1 * | 7/2012 | Bouchard | 52/204.1 |
| 2013/0219814 | A1 * | 8/2013 | Piccirillo | 52/215 |
| 2013/0276391 | A1 * | 10/2013 | Horneland | 52/215 |
| 2013/0276404 | A1 * | 10/2013 | Horneland | 52/742.14 |
| 2014/0130431 | A1 * | 5/2014 | Stewart et al. | 52/215 |

* cited by examiner

INSULATING FIRE AND BLAST RESISTANT WINDOW AND DOOR BUCK

RELATED APPLICATIONS

This application claims priority to U. S. Provisional Application No. 61/629,150 filed Nov. 14, 2011 which is hereby incorporated by reference in its entirety.

BACKGROUND OF THE INVENTION

1. Field of the Invention

The present invention relates generally to insulating concrete form window and door bucks, and more particularly to fire and blast resistant window and door bucks.

2. Description of Related Art

The purpose of this invention is for a self aligning insulating window and door buck that is fire and blast resistant while also being energy efficient.

In constructing insulated concrete walls it is common practice to frame window and door openings in the wall prior to pouring concrete. The most typical window and door buck framing materials for self aligning and non-self aligning bucks are non-insulating materials such as wood, metals, plastics or composites of some kind. When installing window and door bucks for fire or blast protected wall assemblies the window and door buck frames are installed temporarily for the concrete pour and then removed once the concrete is cured, leaving just the thickness of the foam panels of (ICF) wall forms and the cured concrete wall core. Window or door units are fastened directly into the exposed full width concrete wall core to provide blast and fire protection right up to the window or door frame. In this typical window installation method there is not a continuous fastening element around the edges of the rough opening for fastening trim and other finishes. Also with a typical installation of this type if the window and door units are recessed into the wall thickness a band a concrete is exposed on the exterior side of the window and door frames such that the extreme temperatures and moistures can penetrate into the interior of the building. Thus there is strong basic need in the insulated concrete wall forming industry for a window and door solution that provides fastening and insulating components around rough openings that are simple to use and more cost effective.

SUMMARY OF THE INVENTION

The assembled insulated fire and blast resistant window buck is made up of top, sides, and bottom buck sections that are joined together in the corners making a rough opening for door and window units to fit into.

The assembled buck frame includes top, sides and bottom buck sections which are fastened in the corners. The completed buck frame opening matches the rough opening specified for the window and door units that are to be installed. The tops and sides of the buck frame need temporary bracing and support installed to help withstand the concrete pour pressures as well as helping to keep the concrete flush with the buck sections exposed face.

The assembled buck frames can be made to fit any opening size or shape encountered including rounded and arched openings. Some buck assemblies will need to be installed one piece at a time directly into the insulated concrete form (ICF) wall opening as some of the section materials will not be appropriate for corner fastening.

The competed buck frames are made up of individual buck sections that are fastened together at the corners or connecting points. The buck sections can be assembled in the wall forms as individual components or into a buck section assembly at an offsite location or in a factory.

The individual buck frame sections can be made from individual insulating side buck elements with an open space for concrete to flow into for fire and blast protection.

The buck sections can be made from individual side elements with no connecting ties or they can have an integrated spacing tie and anchors and may have face and edge panels joined to the assembly.

The buck sections can be manufactured with add on fire or blast resistant materials that can be applied to the exposed sections face and edges, with the face panels covering the open concrete section between the insulating edge elements.

The changeable fire and blast resistant panels can be added to the buck assemblies for adapting to different finish and window and door systems.

The insulating buck edge elements or the buck assemblies with or without spacing ties can have face and or edge panels added to the assemblies. The panels can be mounted with adhesives, fasteners or by use of clips or snap in holding mechanism or sliding mechanisms.

The buck edge elements can be manufactured to include a spacing tie that can also provide for edge and face fastening as well as being able to integrate anchoring back to concrete.

The internal fastening and spacing ties can be incorporated into the buck assembly thereby providing a positive spacing mechanism and fastening elements.

The fastening and spacing ties can be made out of metal or out of plastics or other elements that provide enough holding and strength for bonding other components and materials. The internal spacing ties can be single or multiple components made with hinge, knock-down capability or as a fixed tie. The fastening and spacing tie can also include a mechanism for integrating an anchor component for embedment into the concrete to add strength to the whole assembly.

The completed buck sections are made from insulating edge elements that can include an internal alignment element for integrating with the concrete form work as well as elements that bond the insulating edge elements to the concrete wall when poured.

The buck sections can be made from individual edge elements providing the capacity for concrete to flow up between the sides into the open portion of the buck.

The insulating buck section edge elements can be solid or hollow or slotted and can be made from insulating materials, to plastics, metals or composites. The edge elements also include an alignment component that locks into the insulated concrete form work and has embedment shapes and surfaces that can bond to the concrete walls when poured.

The integrated buck anchors can be manufactured into the buck sections or can be added on the job site, the anchors can provide both solid fastening for attaching additional elements as well as integrating with the spacing tie components providing additional strength for their edge fastening elements.

The integrated buck anchors provide a solid tie to the walls concrete core for the spacing tie elements.

The integrated anchors can be manufactured as an integral part of the spacing tie elements or can be added onsite. The anchors can be foldable for easier shipping or can be fixed. The anchors can also include slots for inserting reinforcing rods for around doors and window.

Insulated concrete forms are shown in the drawing examples highlighting the buck in use but the buck can be used in any type of concrete wall forms.

The insulated concrete forms are typically two equally spaced insulating panels that have integrated spacing web elements keeping them apart and for withstanding concrete pressures during the concrete pour.

The ICF can be post and beam, waffle grid or flat wall or any variation thereof. The buck system is also adaptable to any concrete wall forming system, including wood, metal, plastic or composites. The insulating buck sections are typically used in insulated concrete walls but this is not required as the bucks can be used in any type of concrete wall.

The individual insulating buck sections can be manufactured with concrete anchoring ports integrated into the face of the bucks allowing for direct attachment of additional elements after the wall is poured.

The insulating buck sections can have concrete ports molded or cut into them for allowing the concrete wall core to flow out to the surface of the buck face. The exposed concrete in the ports allows for structural fastening of additional elements such as windows and doors or other finish materials.

The concrete ports can be any shapes or size, and the interior shapes or sides of the ports can be any shape or configuration for bonding to the concrete.

The invention allows concrete to flow to the inner face of the fire proof or blast resistant rough buck panels or to provide structural concrete to the exposed face of the buck assembly while providing structural edge and face fastening through internal ties with integrated anchoring to concrete. Also, the concrete allows for the solid attachment capability of window and door elements right behind the buck or exposed and flush with the face of the buck.

Another object is to provide a window and door buck that self aligns into position with the insulated wall form cavity prior to concrete placement with various materials.

Another object is to provide a window and door buck that can provide a continuous profile of concrete around window and door buck openings for providing fire and blast protection around openings of insulated concrete buildings.

Another object is to provide a window and door buck that can allow for solid attachment of window and door components directly into an exposed concrete core profile or through an integrated structural fire resistant buck face material around window and door openings.

Another object is to provide a window and door buck that allows for internal wall positioning of reinforcement steel or other types of reinforcing materials around window and door openings in the concrete wall.

Another object is to provide a window and door buck that provides for the incorporation of various fire and blast resistant materials to the exposed surfaces of the window and door buck providing adaptability to differing finish requirements when and where needed.

Another object is to provide a window and door buck that can provide insulating materials around the edges of inset door and window units providing consistent energy efficiency where needed.

Another object is to provide a window and door buck that can provide moisture barrier at any exposed concrete around the edges of inset door and window units to control moisture problems within the building, while still allowing structural fastening to the concrete wall core.

Another object is to provide a window and door buck that can provide integrated anchoring of window and door bucks and units to the concrete wall.

Another object is to provide a window and door buck that can include an interior of wall mechanical component for directing potential water infiltration away from the interior of the building to the exterior face of the wall.

Another object is to provide a window and door buck that self aligns into position within the insulated wall form cavity prior to concrete placement with single or multiple alignment elements.

Another object is to provide a window and door buck that self aligns into position within the concrete wall forms with insulating or non-insulating materials as the alignment elements.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of this application.

BRIEF DESCRIPTION OF THE DRAWINGS

The attached drawings are included to provide additional understanding of the invention and are to be considered part of this description that illustrates the embodiments of the invention, and together with the detailed description provide an explanation of the principles of the invention. Wherein the drawings.

DETAILED DESCRIPTION OF THE DRAWINGS

Figure 1:
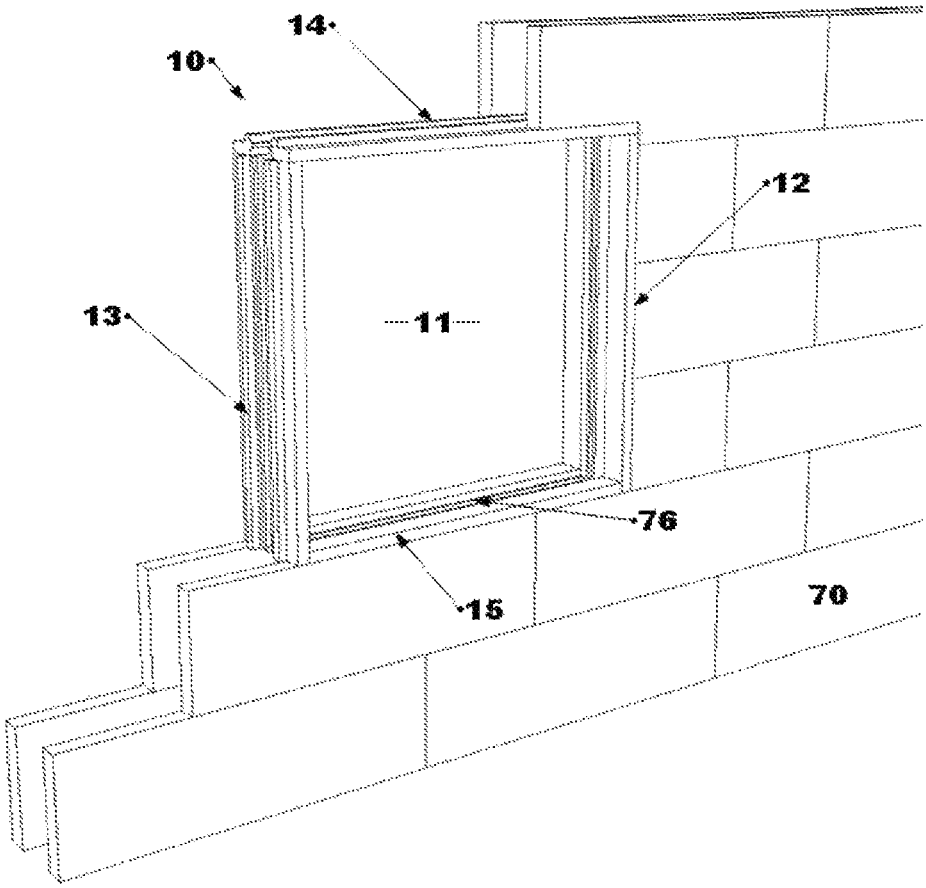
FIG. 1 is an exploded upper perspective view of the present invention, showing an assembled fire and blast resistant window buck frame, set into an insulated concrete formed wall.
Figure 2:
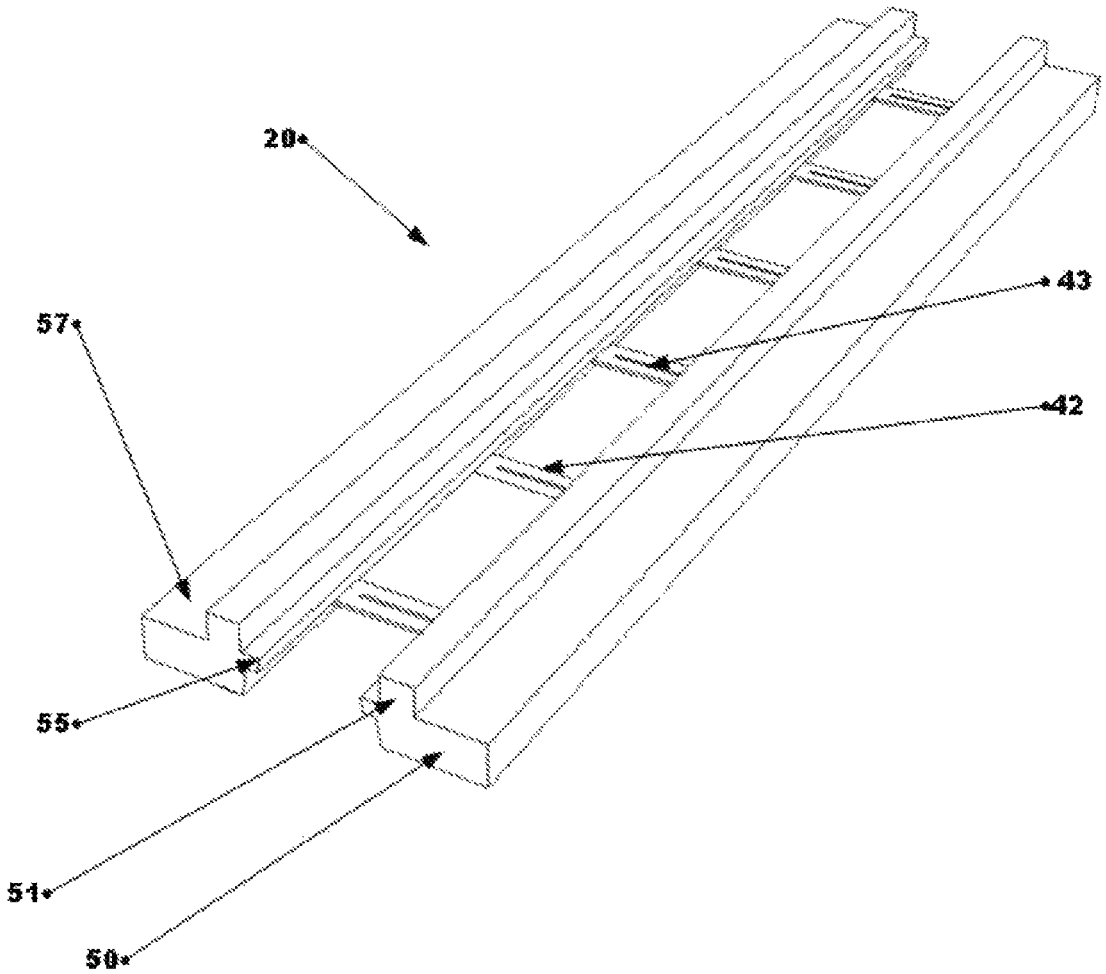
FIG. 2 is an upper perspective view of the present invention, showing a 3-D view of buck side elements of a fire and blast resistant window or door buck frame with an open area in the center portion of the buck for concrete to flow between the insulated edge alignment elements.
Figure 2A:
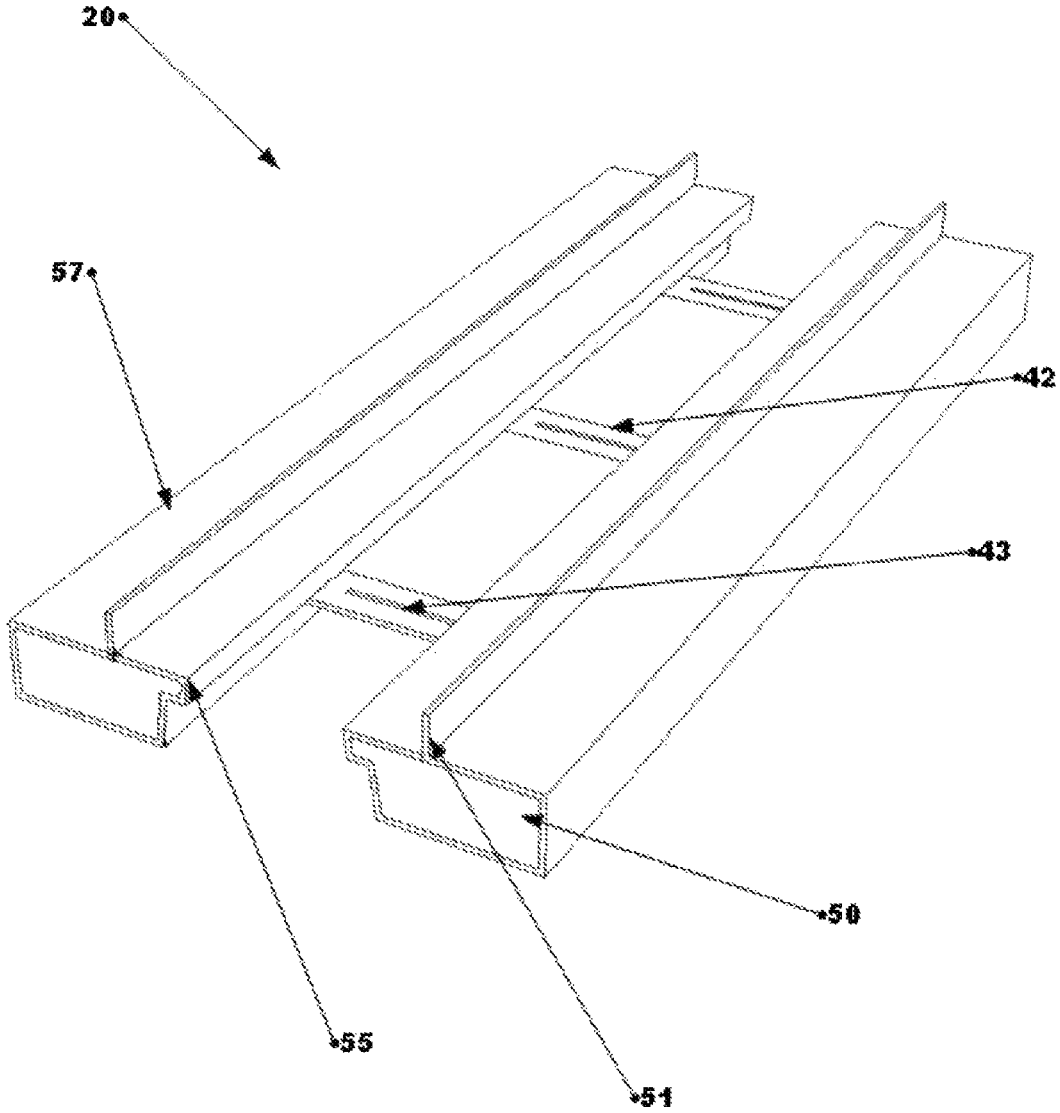
FIG. 2A is an upper perspective view of the present invention, showing a perspective view of a buck section with a composite shell with an internal component of insulation.
Figure 3:
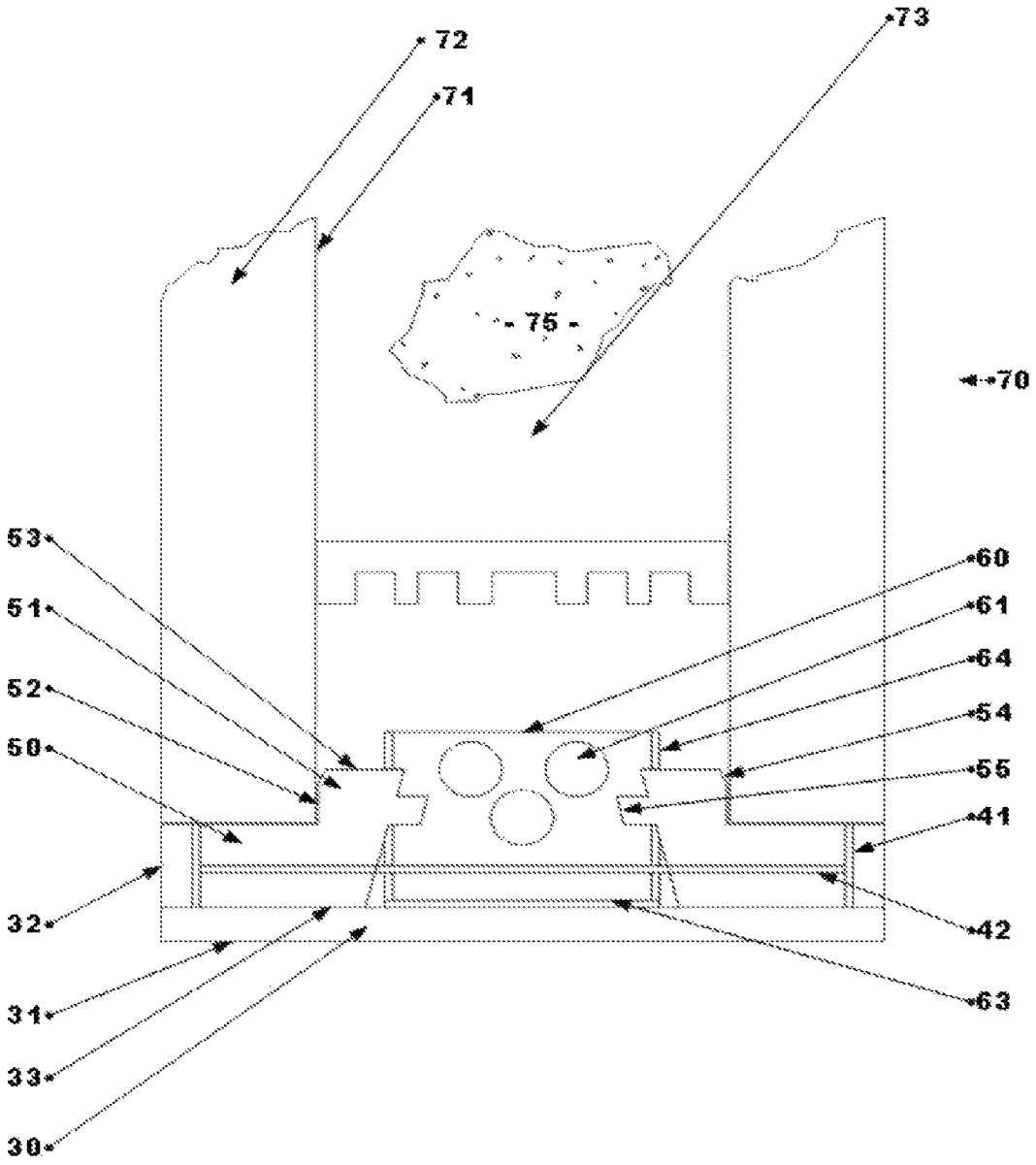
FIG. 3 is a front view of the present invention, showing a section view of an Insulated Concrete Formed wall with a cut view of the fire and blast resistant window or door buck that shows internal fastening elements and integrated concrete anchor with alignment holes for reinforcement rods.
Figure 4:
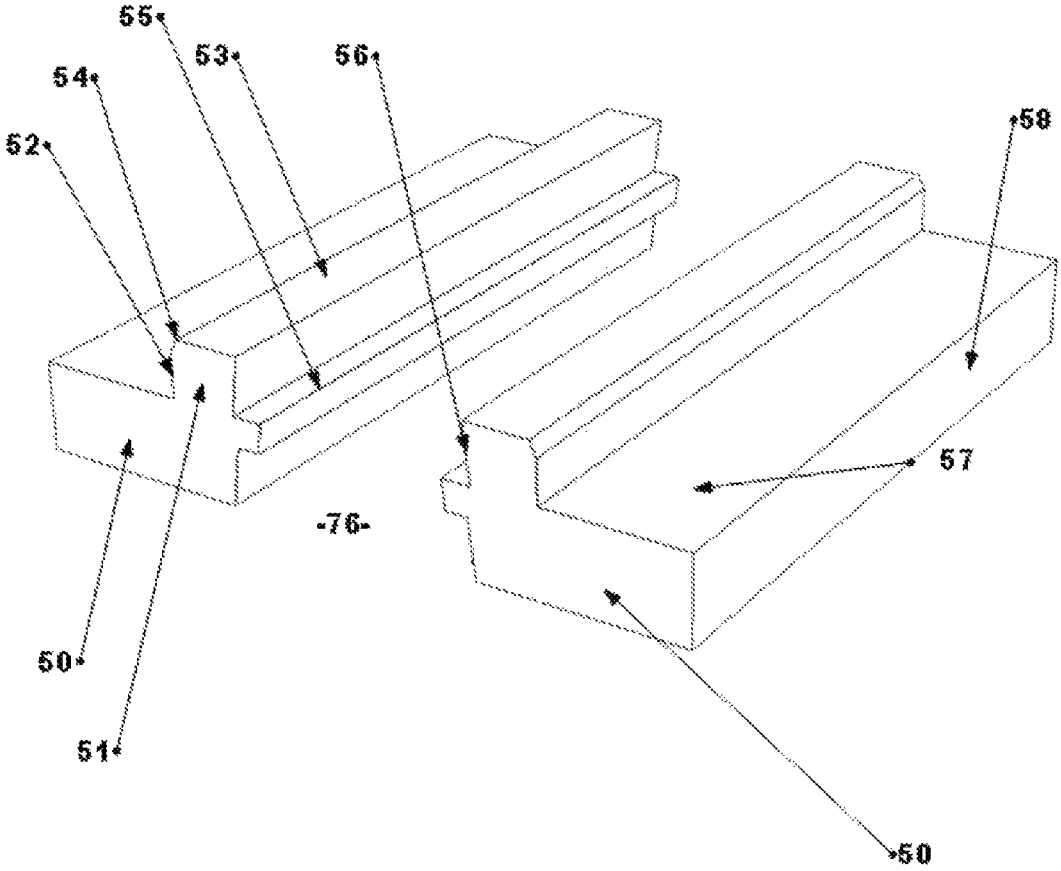
FIG. 4 is an upper perspective view of the present invention, showing a 3-D view of two parallel insulating edge alignment elements that can be paired as a fire and blast resistant buck that allows concrete to flow between the edge elements forming a profile of concrete that surrounds a window or door.
Figure 5:
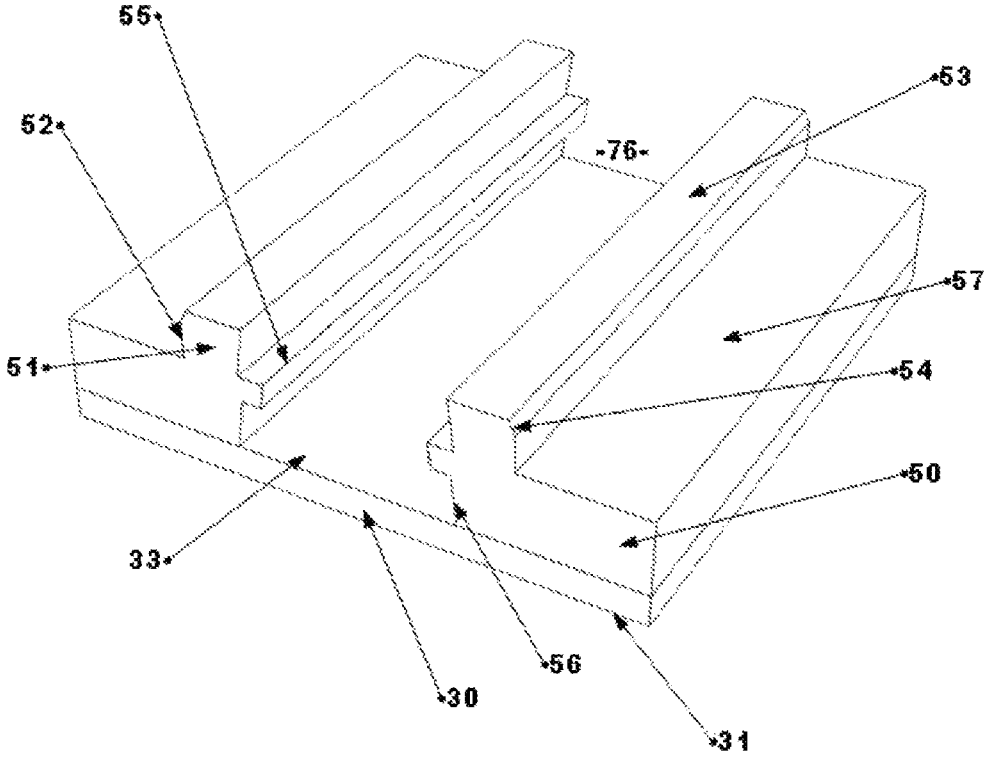
FIG. 5 is an upper perspective view of the present invention, showing a 3-D view of two parallel insulating edge alignment elements with an addition of a fire or blast resistant surface material on the exposed face of the edge components.
Figure 6:
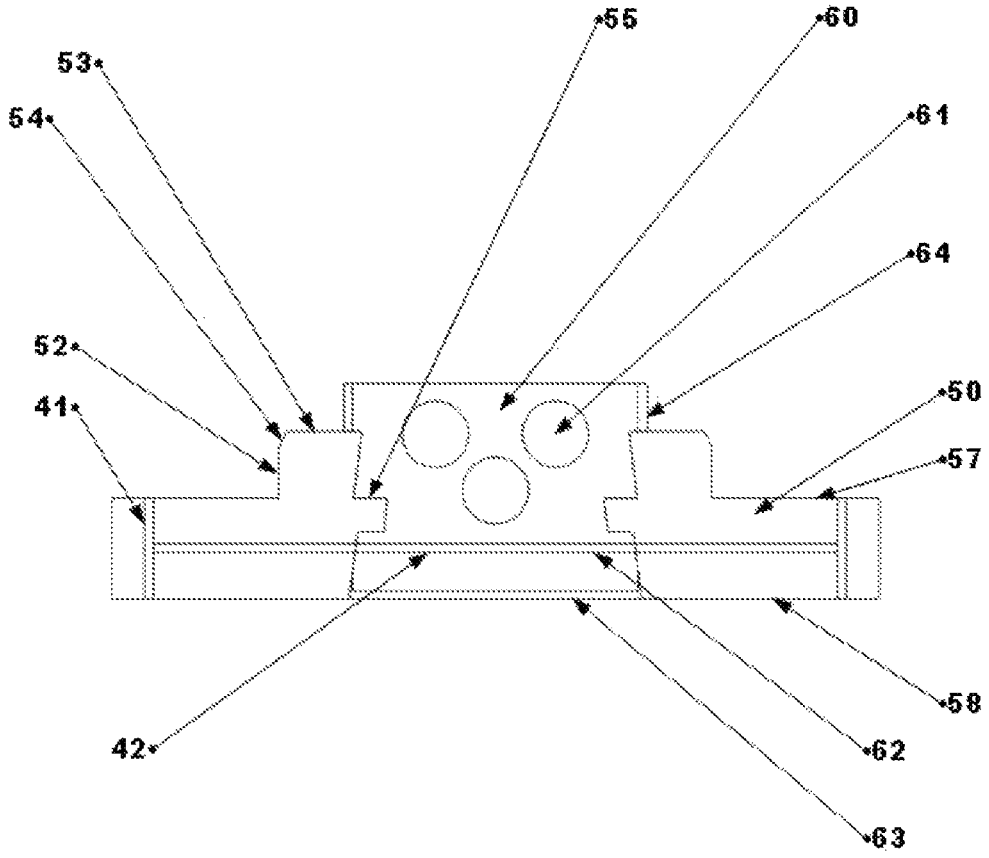
FIG. 6 is an end view of the present invention, showing an end section view of a fire or blast resistant window or door buck with internal edge fastening elements and reinforcing alignment and anchoring component.
Figure 7:
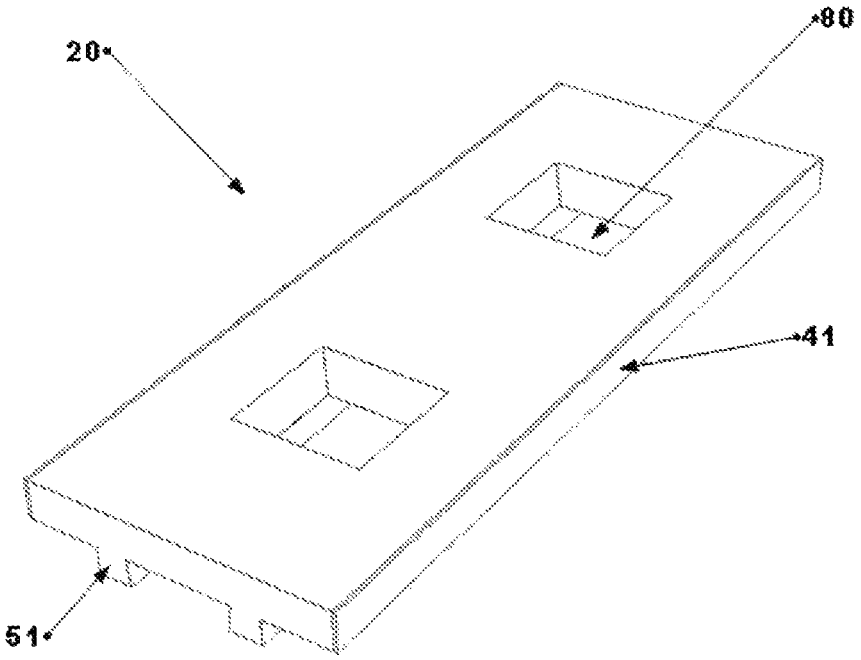
FIG. 7 is an upper perspective view of the present invention, showing a perspective view of a section of buck that has cut out shapes for concrete to flow out and flush with the face of the buck for fastening.
Figure 8:
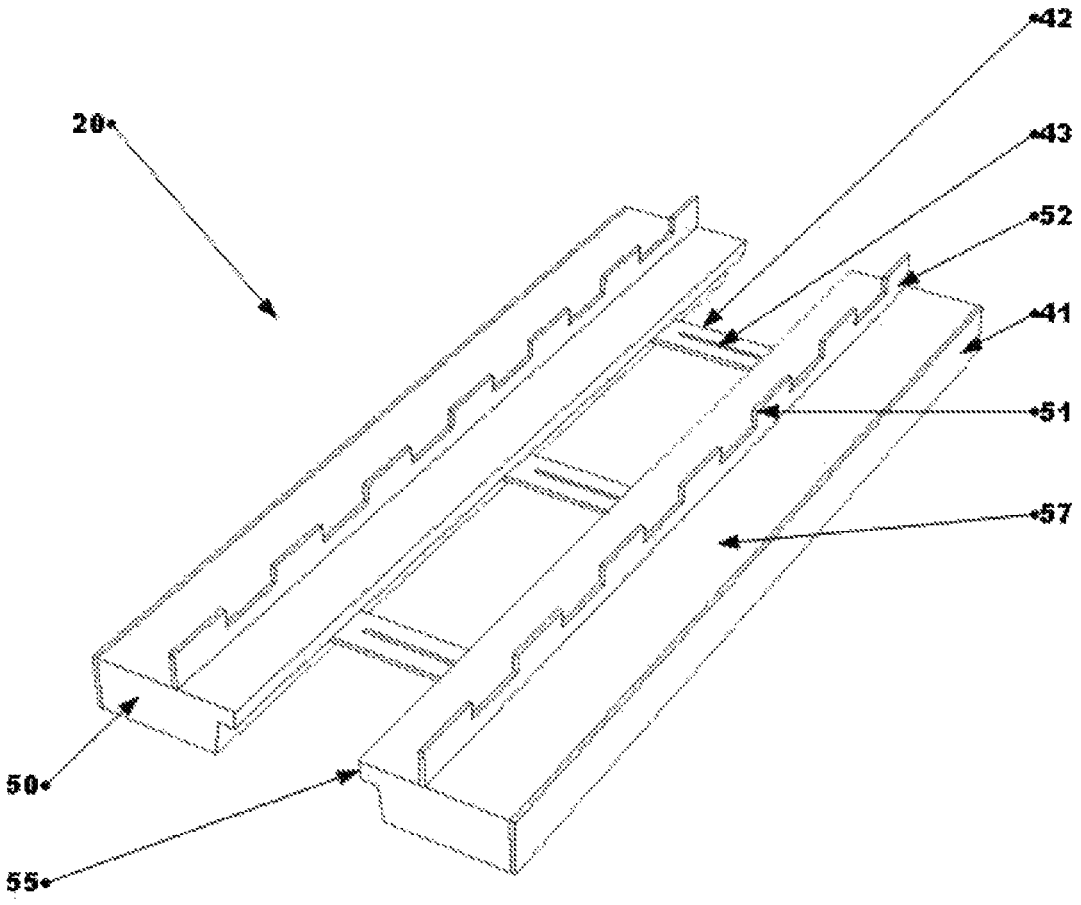
FIG. 8 is an upper perspective view of the present invention, showing a section of buck with internal ties that allow the insertion of anchors and non insulating internal alignment elements that are not uniformly shaped.
Figure 8A:
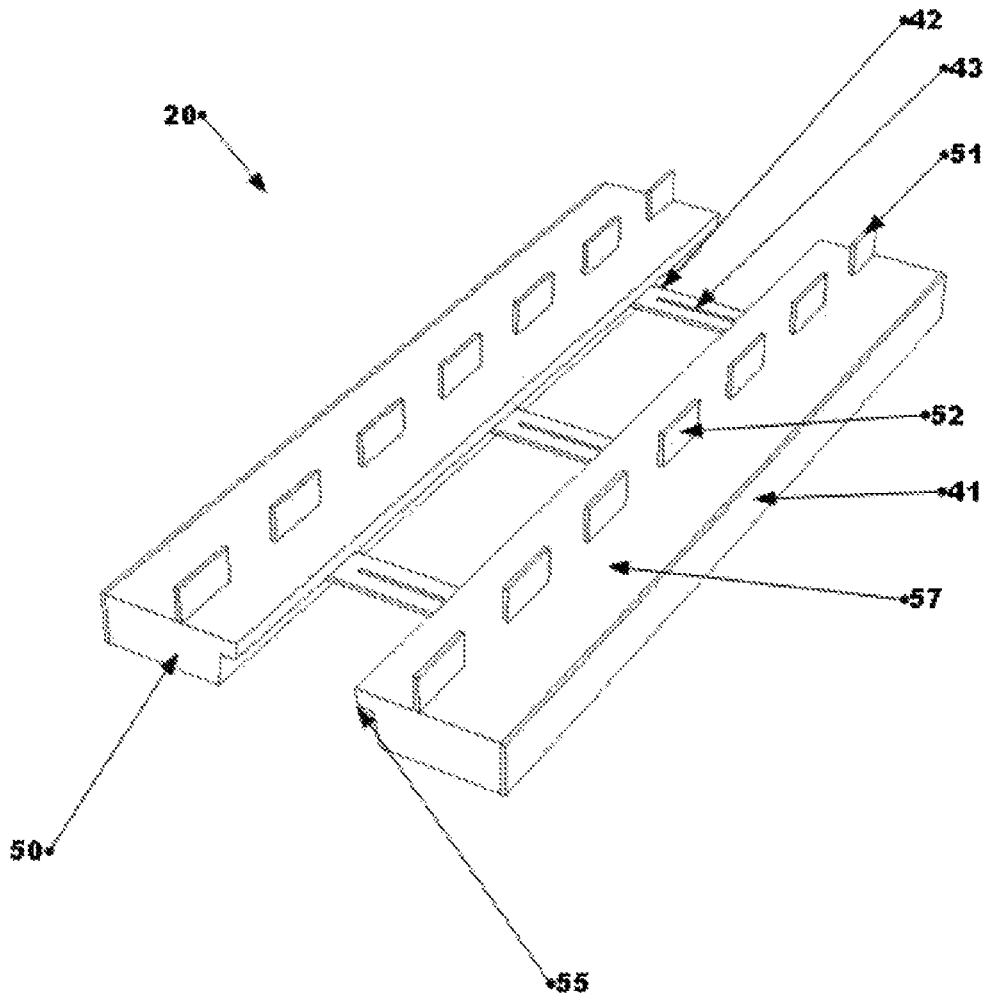
FIG. 8A is an upper perspective view of the present invention, showing a section of buck with non insulating internal alignment elements that are intermittent and not continuous.
Figure 9:
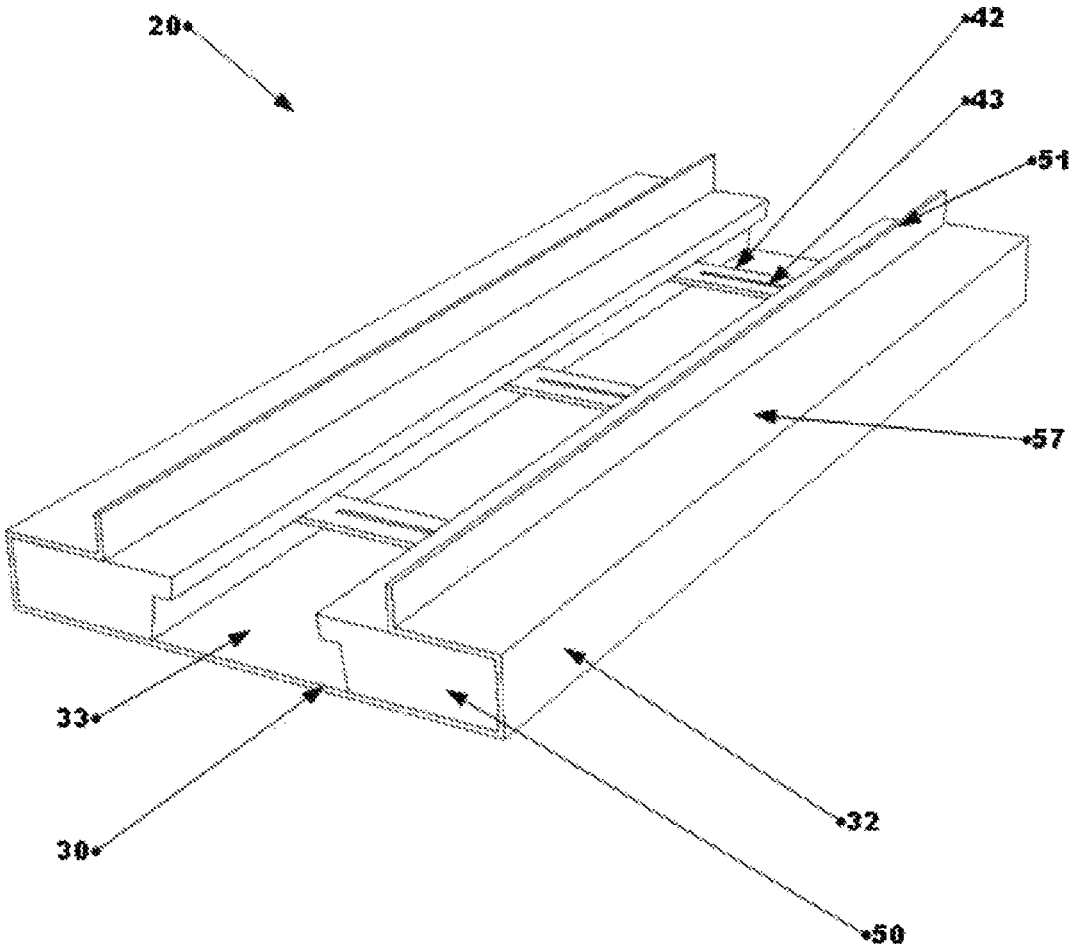
FIG. 9 is an upper perspective view of the present invention, showing a section of buck with a wrap around skin that provides the exposed concrete on the face of the buck as well as the internal reinforcing alignment elements.
Figure 10:
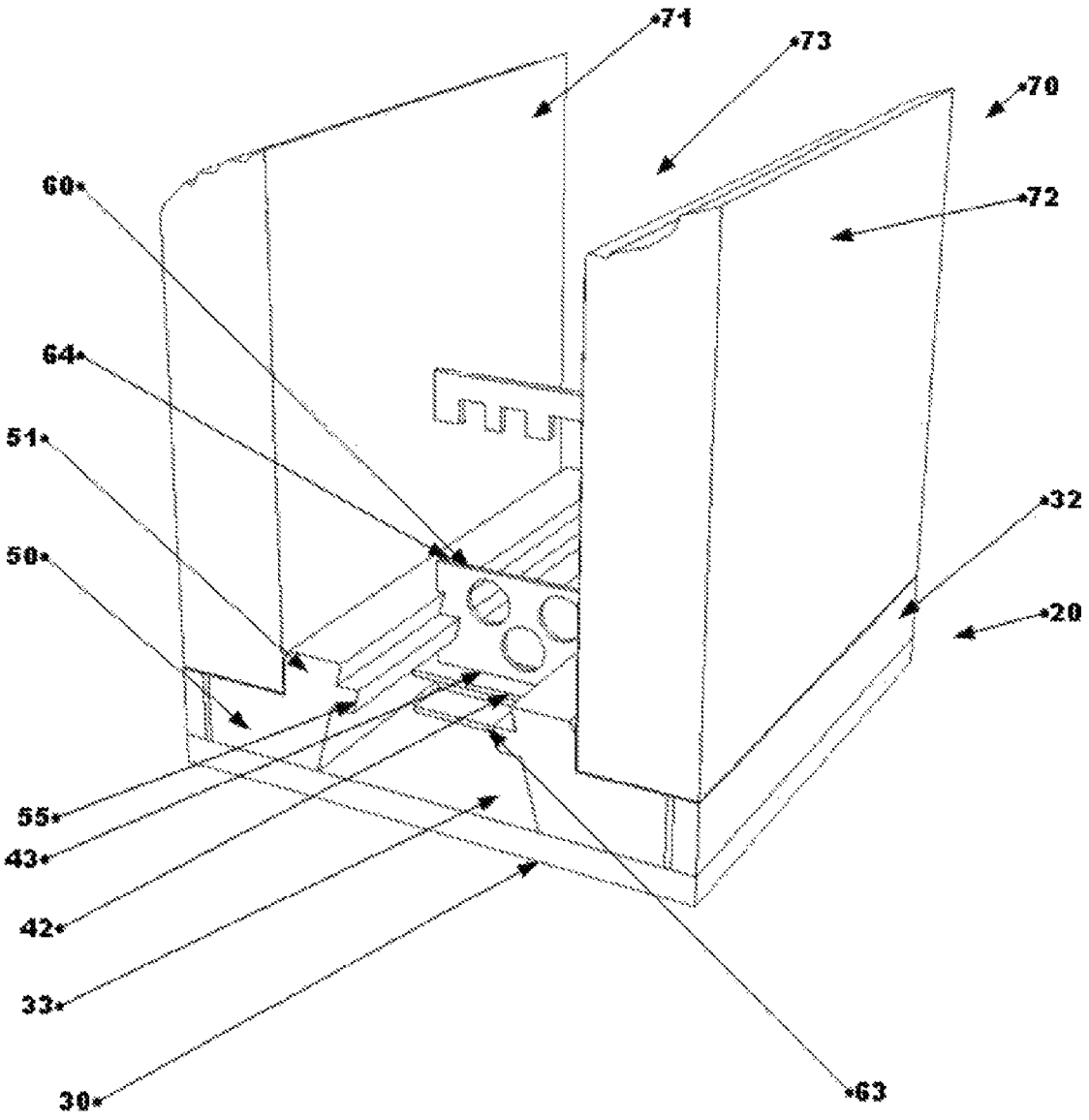
FIG. 10 is an exploded upper perspective view of the present invention, showing a perspective section of buck that includes a section of ICF block as well as installed face and side panels and anchor.
Figure 11:
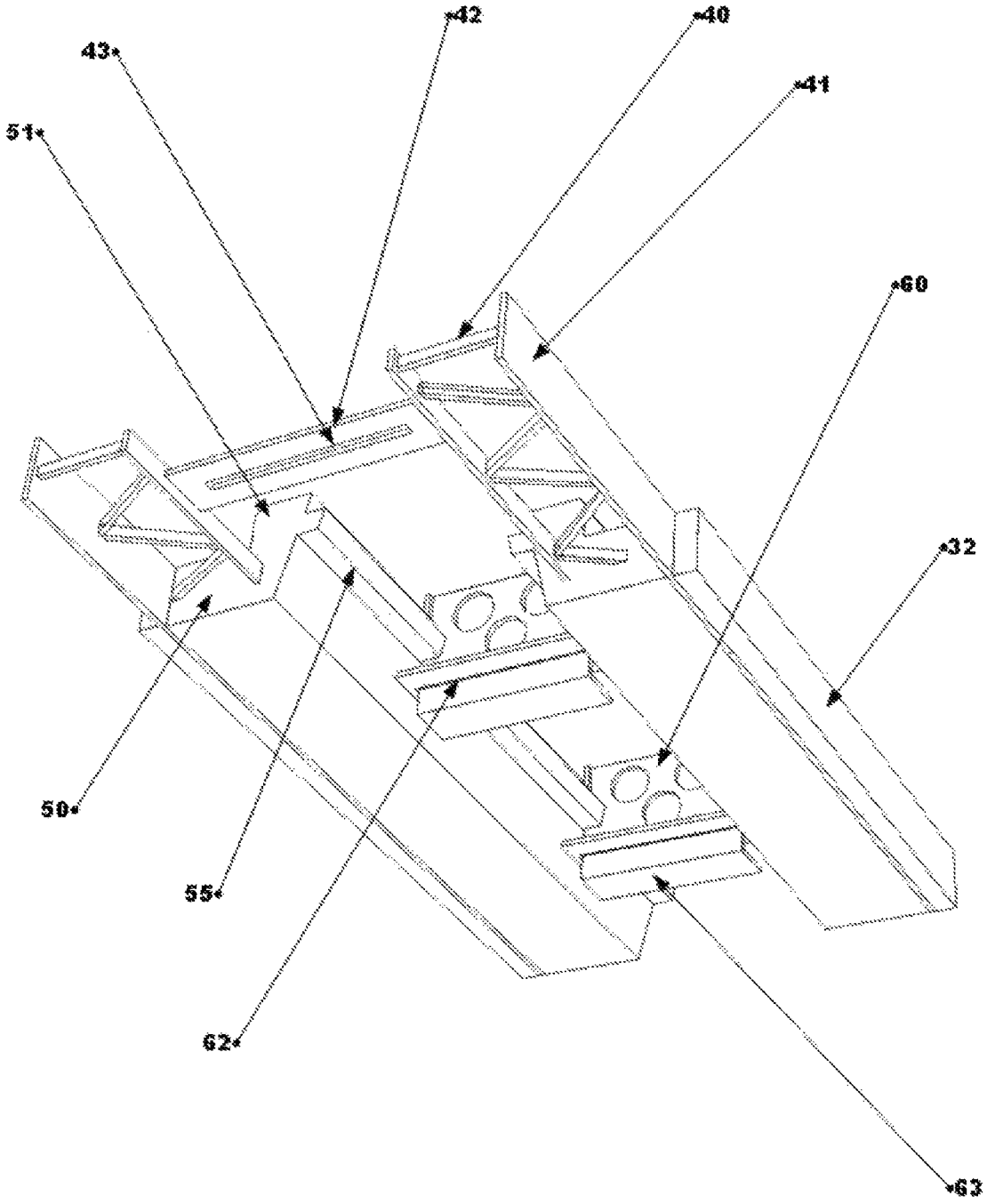
FIG. 11 is an exploded lower perspective view of the present invention, showing a perspective view of a buck section with the internal tie spacer element with connecting anchors and edge fastening elements.

The present invention is referred to generally in FIGS. 1-11 by the reference numeral 10 and is intended to provide for insulating concrete form window and door bucks. Like numbers refer to like elements throughout the figures. It should be understood that the device 10 may be used in a variety of wall forms and is not to be limited in use to only insulated concrete forms. Furthermore, it is noted that the present invention may be monolithically formed as a single unit thereby negating the necessity to mechanically attach its various parts together.

The assembled buck frames 10, make a rough opening 11, with the frames being made up of a right side buck section 12, and a left side buck section 13, a top buck section 14, all coming together in a bottom or sill buck section 15. The individual insulating buck sections 20 can either be made of solid insulating materials or can be made from a composite of materials with an insulating element to the buck section 20, buy using insulating materials along with metals, plastics, woods, or composites. The Individual insulating buck sections 20, can have added fire and blast resistant panels 30, the exterior surface of buck face panel 31 is the side the faces the assembled buck frame rough opening 11. Exterior buck edge panel pieces 32 can be added to the exposed edges of the individual insulating buck sections 20 with the finished edge panel surfaces being flush with the finished interior and exterior surfaces of the ICF wall 70 or the concrete wall surface. The ICF concrete core 75 flows into direct contact with interior surface of buck face panels 33 or a waterproofing barrier if applied. Internal fastening and spacing ties 40 can be molded into the individual insulating buck sections 20, the internal fastening and spacing ties 40 can have internal tie edge fastening flanges 41 that are either buried or exposed and are joined to their opposing internal tie edge fastening flange 41 with an internal tie spacing element 42, with the internal tie spacing element 42 having the capability of having an internal tie anchor attachment mechanism for adding on integrated buck anchors 60. The insulating buck edge elements 50 are made up of internal alignment elements 51 which have a friction face of alignment element 52 and can have a top face of alignment element 53 and can also have an eased edge of the alignment element 54 to assist in joining with an ICF wall 70, with the ICF bonding edge of buck 57 being the connection point between the two components. The insulating buck edge elements 50 also can have locking embedment shapes 55 and or locking embedment surfaces that bond to the walls concrete core 75 and the exterior face of edge elements 58 being oriented to the rough opening 11 of the assembled buck frame 10. The internal fastening and spacing ties 40 can have an integrated buck anchor 60 as part of the assembly allowing a structural bond to the ICF concrete core 75. The integrated buck anchors 60 can have reinforcing alignment holes or slots 61 with the integrated anchors can be manufactured as one piece with the internal fastening and spacing ties 40 or can be added as a separate component with an attachment point or mechanism between the internal spacing tie and the anchor 62, the integrated buck anchors 60 can also have an anchor fastening flange 63 that allows for fastening of any types of materials or components onto the exterior face of the edge element 58. The integrated anchors can also have flared anchor edge shapes 64 which is a profile of the anchor material that flares out of the plane or the anchors and give it more rigidity and binding mechanism when inserted into an insulating material. The examples used for his invention is in an ICF wall 70 even though the wall could be any shape or size concrete wall with or without insulation. The ICF wall 70 has an internal face of ICF block panel 71 which interfaces with the internal alignment elements 51, the ICF wall 70 can have ICF block side panels 72 and an ICF block cavity 73 when both sides of the forms are installed, and then the cavity 73 is filled with fluid concrete to become the ICF concrete core 75 and in between the insulating buck edge elements 50 an exposed concrete fin at the exposed buck face 76 can be formed when poured.

The individual buck sections 20 can be manufactured as a single unit or it can be installed as separate components on the jobsite. Also the buck sections can be made into a composite insulating buck section 20 with the use of wood, metal, plastics or a composite of materials made into a profile that allows for an exposed concrete fin at exposed buck face 76. The Individual insulating buck sections 20 can have a wide array of fire and blast resistant panels 30 installed in either just the exterior buck edge panel pieces 32 installed or non at all or just an exterior surface of buck face panel 31 can be installed or a combination of both 31 or 32. The internal fastening and spacing tie 40 can be made of plastics, woods, composites or metals as long as they provide a structural strength to fasten into with screws nails and other assorted fasteners. The Internal fastening and spacing tie 40 can also be made as a single piece or as a group of components that can be assembled into a finished tie 40. The internal tie 40 can also be folding or in a knockdown configuration and the internal tie anchor attachment mechanism 43 can be as simple as a slot that an integrated buck anchor 60 can slide into or can be a snapping mechanism that joins the tie 40 with the anchor 60. The integrated buck anchor 60 can have either holes or slots to hold the reinforcing members in place and the anchors 60 can be made with or without an anchor fastening flange 63.

The concrete fastening buck ports 80 can be made in a type of insulating buck material or a composite of materials with an insulating element as part of the assembly. The shapes of the holes can be any shape size or configuration as long as it can function as a structural concrete attachment point.

With concrete construction it is often required to have blast and or fire protection right up to the frames of windows and doors while still being able to have a high degree of energy efficiency. The invention can provide a solid continuous profile of concrete 76 around the window and door openings right up to the frame of the window and door units. The door and window units can be fastened directly to the concrete profile or a fire or blast resistant panel 31 can be added to the face of the buck for applications of different finishes. The buck can also incorporate anchors 60 with the panels can be attached to and the window and door units can also be attached to the anchors 60. The individual buck sections 20 and 21 can be joined together at the corners and installed as an assemble buck frame 10 or they can be built onsite with the individual buck sections 20 and 21 or they can be assembled onsite from the individual buck edge elements 50. The buck sections 20 and 21 can be made from two parallel buck edge elements 50 that can be molded into a single buck section 20 thereby keeping the internal alignment elements 51 properly spaced or the edge elements 50 can be bonded to a fire resistant panel 30 to keep the spacing of the internal alignment elements 51 properly spaced or an anchor 60 can be installed between two buck edge elements 50 to obtain the proper spacing of the internal alignment elements 51. The buck sections 20 or 21 or the assembled frames 10 are then friction fitted into concrete wall form work and then braced in place to withstand the pressures of the concrete pour.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention in which all terms are meant in their broadest, reasonable sense unless otherwise indicated. Any headings utilized within the description are for convenience only and have no legal or limiting effect.

I claim:

1. A window and door buck, the buck being fittable to insulated concrete wall forms that have two side panels having substantially parallel inside panel faces and that are separated from each other by a wall form cavity and exterior panel faces substantially parallel to the substantially parallel inside panel faces, said buck comprising:

a first insulation member, a second insulation member, a tie piece, a first internal alignment element, and a second internal alignment element, said tie piece having a first end portion, a middle portion, and a second end portion, with each said insulation member comprising an interior face that faces the wall form cavity, a substantially flat exterior face that faces a rough opening in the insulated concrete wall forms, and an outer face that joins the interior face and the substantially flat exterior face, with the first insulation member attached to the tie piece first end portion and the second insulation member attached to the tie piece second end portion, with the tie piece middle portion being free of insulation, with the tie piece fixing the exterior faces of the first insulation member and the second insulation member in a same plane, and also maintaining a gap between the first insulation member and the second insulation member that prevents all contact between said first insulation member and said second insulation member, said gap being finable with a substantially unbroken barrier of concrete, with the first internal alignment element comprising a first alignment face and a first substantially flat face that connects the outer face of the first insulation member of the buck to the first alignment face, and the second internal alignment element comprising a second alignment face and a second substantially flat face that connects the outer face of the second insulation member to the second alignment face, and with the first internal alignment face being substantially perpendicular to the first substantially flat face and the second internal alignment face being substantially perpendicular to the second substantially flat face, said internal alignment elements being proportioned to fit inside the wall form cavity of the insulated concrete wall form to position the buck for concrete placement with the internal alignment faces in contact with the inside panel faces of the insulated concrete wall form.

2. The buck of claim 1 further comprising a gap face that faces the gap with the gap face shaped to bond to concrete.

3. The buck of claim 1 wherein the first insulation member and the second insulation member each further comprise a flange;

wherein said flanges are connected to each other by a plurality of individual cross ties at regular intervals along a length of the buck; and wherein said cross ties are substantially parallel to the substantially flat exterior face.

4. The buck of claim 1 further comprising at least one fire or blast resistant panel wherein the fire or blast resistant panel is proportioned to extend from the substantially flat exterior face to the interior face and wherein the fire or blast resistant panel is attached to the outer face of the first and second insulation members.

5. The buck of claim 1 further comprising a fire or blast resistant panel wherein the fire or blast resistant panel at least partially encompasses the insulation members.

6. The buck of claim 1 further comprising a fire or blast resistant panel wherein the fire or blast resistant panel encompasses at least one of the insulation members.

7. The buck of claim 1 wherein the tie piece further comprises a slot to receive a concrete anchor.

8. The buck of claim 1 further comprising a concrete anchor that comprises voids or structures to embed the concrete anchor into concrete.

9. The buck of claim 1 further comprising a removable concrete anchor.

10. The buck of claim 1 further comprising a fixed concrete anchor attached to the tie piece.

11. The buck of claim 1 further comprising a concrete anchor attached to the tie piece with a hinged or bendable connection that allows the anchor to be folded relative to the buck.

12. The buck of claim 1 further comprising a fire or blast resistant panel wherein the fire or blast resistant panel is proportioned to extend from the first outer face to the second outer face and wherein the fire or blast resistant panel is attached to the substantially flat exterior face of the first insulation member and the substantially flat exterior face of the second insulation member.

13. The buck of claim 12 wherein the fire or blast resistant panel is configured to receive a window or door unit.

14. The buck of claim 1 further comprising a concrete anchor.

15. The buck of claim 14 wherein the concrete anchor is configured to receive a window or door unit.

* * * * *